US005234397A

United States Patent [19]

Wahle et al.

[11] Patent Number: 5,234,397

[45] Date of Patent: Aug. 10, 1993

[54] METHOD OF AND APPARATUS FOR MAKING COMPOSITE FILTER ROD SECTIONS FOR USE IN FILTER TIPPING MACHINES

[75] Inventors: Günter Wahle, Reinbek; Heinz-Christen Lorenzen, Wentorf, both of Fed. Rep. of Germany

[73] Assignee: Körber AG, Hamburg, Fed. Rep. of Germany

[21] Appl. No.: 847,822

[22] Filed: Mar. 6, 1992

[30] Foreign Application Priority Data

Mar. 23, 1991 [DE] Fed. Rep. of Germany ..... 4109603

[51] Int. Cl.[5] ..... A24D 3/02; A24D 3/04; A24D 3/16

[52] U.S. Cl. ..... 493/4; 493/47; 493/49

[58] Field of Search ..... 493/4, 44, 45, 47, 49

[56] References Cited

U.S. PATENT DOCUMENTS

| | | | |
|---|---|---|---|
| T941,011 | 5/1974 | Morrison | 93/1 C |
| 3,974,007 | 8/1976 | Greve | 156/64 |
| 4,132,189 | 1/1979 | Greve | 118/8 |
| 4,223,551 | 9/1980 | Greve | 73/38 |
| 4,259,769 | 4/1981 | Greve | 28/283 |
| 4,511,420 | 4/1985 | Arthur | 156/356 |
| 4,776,351 | 10/1988 | Wahle | 131/69 |
| 4,865,054 | 9/1989 | Lorenzen | 131/280 |
| 4,878,506 | 11/1989 | Pinck | 131/84.4 |
| 4,889,139 | 12/1989 | Heitmann | 131/84.3 |
| 4,926,886 | 5/1990 | Lorenzen | 131/84.4 |
| 4,941,482 | 7/1990 | Heitmann | 131/84.4 |

FOREIGN PATENT DOCUMENTS

| | | |
|---|---|---|
| 2259715 | 6/1974 | Fed. Rep. of Germany . |
| 3823707 | 1/1990 | Fed. Rep. of Germany . |

*Primary Examiner*—William E. Terrell
*Attorney, Agent, or Firm*—Peter K. Kontler

[57] ABSTRACT

A continuous tow of filamentary filter material is advanced past a rotary applicator which delivers metered but variable quantities of a second filter material (such as granulated or pulverulent charcoal) into successive increments of the tow. The tow and the delivered second filter material are thereupon draped into a web of wrapping material to form a filter rod which is subdivided into sections of desired length. The density and/or the mass of the filter rod or of successive filter rod sections is monitored and the results of such monitoring operation are utilized to regulate the rate of delivery of second filter material so that the mass or density of the rod remains constant. The draw resistance of the filter rod or of filter rod sections can be monitored to generate signals which are used to regulate the rate of advancement of the tow toward the draping station and to thus maintain the draw resistance at least substantially constant.

11 Claims, 3 Drawing Sheets

METHOD OF AND APPARATUS FOR MAKING COMPOSITE FILTER ROD SECTIONS FOR USE IN FILTER TIPPING MACHINES

BACKGROUND OF THE INVENTION

The invention relates to improvements in making filter rod sections for use in machines for the production of filter cigarettes or other filter tipped rod-shaped products of the tobacco processing industry. More particularly, the invention relates to improvements in methods of and in apparatus for making composite filter rod sections which can be utilized as tobacco filtering portions of filter cigarettes and the like.

It is already known to make filter rod sections from a continuous strand (normally called tow) of fibrous filter material (such as acetate fibers) which is drawn from a source of supply (normally in the form of a bale of highly compacted tow) and is thereupon subjected to a number of treatments (including spreading, stretching, sprinkling with a softening agent and condensing) prior to draping into a continuous web of wrapping material (such as imitation cork or cigarette paper). The thus obtained filter rod is thereupon subdivided into sections of desired length, and such sections are transported to storage or into a tipping machine, e.g., into a filter tipping machine wherein filter rod sections of unit length or multiple unit length are connected with plain cigarettes of selected length.

It is also known to contact the running tow of fibrous filter material with another filtering component in order to enhance the desirable characteristics of the resulting filter rod sections. A presently preferred filtering component which is added to successive increments of the running tow of acetate fibers or other filamentary filter material is activated carbon which is admitted in granular or pulverulent state. Reference may be had, for example, to commonly owned published German patent application No. 38 23 707 of Wolfgang Steiniger et al. The thus obtained so-called charcoal filters have been found to be highly satisfactory in that they can intercept high percentages of tar and nicotine from tobacco smoke which flows from the lighted end of a filter cigarette or a like smoker's product to the mouth of the smoker. The published German patent application of Steiniger et al. proposes to add metered quantities of activated carbon to successive increments of the running tow downstream of the last tow treating station and immediately ahead of the wrapping mechanism wherein the tow (which carries particles of activated carbon) and wrapping material are converted into a continuous filter rod which is ready to pass through a so-called cutoff in order to be subdivided into filter rod sections of desired length.

OBJECTS OF THE INVENTION

An object of the invention is to provide a novel and improved method of making a composite filter rod which can be subdivided into filter rod sections for use in filter tipping machines for cigarettes and the like.

Another object of the invention is to provide a method which renders it possible to select the rate of admission of at least one additional filtering component to a running tow of filamentary filter material in such a way that each unit length of the filter rod exhibits the desirable characteristics, such as hardness, mass and/or draw resistance (i.e., resistance which the filter mouthpiece of a filter cigarette or the like offers to the flow of tobacco smoke therethrough).

A further object of the invention is to provide a novel and improved method of influencing the percentages of various constituents of a filter rod which can be subdivided into mouthpieces of desired length for use in filter tipping machines for cigarettes or the like.

An additional object of the invention is to provide a novel and improved method of regulating the rate of admission of comminuted (granular or pulverulent) activated carbon to a running tow of acetate fibers or other suitable filamentary filter material.

A further object of the invention is to provide a method which can be carried out in line or by resorting to selected numbers of specimens (such as sections of a continuous filter rod).

Another object of the invention is to provide a novel and improved apparatus for the practice of the above outlined method.

An additional object of the invention is to provide the apparatus with novel and improved means for regulating the rate of admission of at least one of several different constituents of a filter rod preparatory to draping of the constituents into a continuous strip or web of wrapping material.

Still another object of the invention is to provide a novel and improved testing system which can be installed in or incorporated into the above outlined apparatus to facilitate the regulation of the percentages of various constituents of a continuous filter rod A further object of the invention is to provide an apparatus which can produce a superior filter rod whose characteristics change little or not at all and whose characteristics can be selected and thereupon maintained in a simple and efficient manner An additional object of the invention is to provide a filter rod making machine or apparatus which ensures that the draw resistance of successive sections of the filter rod will remain constant or can be rapidly changed to satisfy the requirements in connection with the making of a particular brand of filter cigarettes or other filter tipped rod-shaped articles of the tobacco processing industry.

Another object of the invention is to provide an apparatus which renders it possible to combine a plurality of different tobacco smoke filtering components in an economical manner without wasting any of the various components, especially of that component or of those components which is or are more expensive than the other component or components.

A further object of the invention is to provide a production line which is designed to turn out filter cigarettes or other filter tipped rod-shaped smokers' products and which embodies one or more apparatus of the above outlined character.

An additional object of the invention is to provide a novel and improved apparatus for the making of so-called charcoal filters Still another object of the invention is to provide a novel and improved filter rod for subdivision into filter rod sections which can be used in filter tipping machines for mass production of filter cigarettes and the like.

An additional object of the invention is to provide rod-shaped smokers' products which embody filters of the above outlined character.

A further object of the invention is to provide novel and improved rod monitoring and material metering means for use in the above outlined apparatus.

SUMMARY OF THE INVENTION

One feature of the present invention resides in the provision of a method of producing filter rod sections for the making of filter cigarettes or analogous smokable rod-shaped articles of the tobacco processing industry. The method comprises the steps of advancing a continuous first filter material (e.g., a tow of acetate fibers) in a predetermined direction along an elongated path, delivering at least one second filter material into a first portion of the path and jointly advancing the filter materials beyond the first portion, draping the filter materials into a wrapping material (e.g., into a web of cigarette paper) in a second portion of the path to form a continuous rod having at least one variable characteristic (such as mass, density and/or draw resistance), subdividing the rod into a series (e.g., a file or row) of discrete filter rod sections in a third portion of the path downstream of the second portion, monitoring the at least one variable characteristic of the rod and generating signals denoting the monitored characteristic, and regulating the rate of delivery of the at least one second filter material into the first portion of the path as a function of variations of the signals in response to variations of the monitored characteristic of the rod.

The at least one second filter material can contain or can constitute activated carbon (such as charcoal), preferably in granular or pulverulent form.

The method can further comprise the step of regulating the quantity of first filter material in the rod as a function of variations of draw resistance of the rod so as to maintain the draw resistance at or close to a predetermined value.

The monitoring step can include monitoring the at least one characteristic of the rod in the path (in-line operation) Alternatively, the monitoring step can include monitoring the at least one characteristic of the filter rod subsequent to subdivision of the rod into filter rod sections Such monitoring step can be carried out outside of the elongated path, e.g., subsequent to transfer or transport of selected numbers of filter rod sections into a laboratory.

It is equally within the purview of the invention to monitor a plurality of variable characteristics of the rod, for example, the mass or density and the draw resistance. The monitoring can include a step of monitoring the mass or density of the rod and the step of monitoring the draw resistance to the rod (prior or subsequent to the subdividing step). The regulating step of such method can comprise a first step of regulating the rate of delivery of the at least one second filter material as a function of variations of signals denoting the monitored mass or density or as a function of variations of signals denoting the draw resistance, and a second step of regulating the quantity of first filter material in the rod in response to variations of signals denoting the mass or density of the rod or as a function of variations of signals denoting the draw resistance of the rod.

Another feature of the present invention resides in the provision of an apparatus for producing filter rod sections for the making of filter cigarettes or analogous smokable rod-shaped articles of the tobacco processing industry from an elongated first filter material and at least one second filter material The improved apparatus comprises means for advancing the first filter material (e.g., an elongated tow of acetate fibers or other suitable filamentary filter material) from a first source (e.g., a so-called bale) in a predetermined direction along an elongated path, means for delivering the at least one second filter material (e.g., pulverulent or granulated charcoal) from a second source (e.g., a magazine) into a first portion of the path so that the thus supplied at least one second filter material advances with the first filter material beyond the first portion of the path, means for draping the filter materials into a wrapping material (e.g., a web of cigarette paper) in a second portion of the path downstream of the first portion to thus form a continuous filter rod having at least one variable characteristic (such as mass, density and/or draw resistance), a so-called cutoff or other suitable means for subdividing the filter rod into a series (e.g., a file) of discrete filter rod sections of desired length in a third portion of the path downstream of the second portion, means for monitoring the at least one variable characteristic of the rod and for generating signals which denote the monitored characteristic, and means for regulating the rate of delivery of the at least one second filter material into the first portion of the path as a function of variations of the signals in response to variations of the monitored characteristic.

The second source can be installed adjacent the first portion of the path, i.e., downstream of first source but upstream of the draping means.

If the at least one variable characteristic of the filter rod is its mass, the monitoring means can include a source of penetrative radiation (e.g., a source of beta rays) and means for directing radiation from the respective source against successive increments of the advancing rod.

The monitoring means can be arranged to monitor the characteristics of selected or all filter rod sections, e.g., to monitor the draw resistance of discrete filter rod sections. Such monitoring means can be installed adjacent a fourth portion of the path downstream of the third portion. The apparatus can further comprise means for regulating the quantity of first filter material in the rod as a function of monitored variations of draw resistance of the rod and/or filter rod sections. The means for regulating the quantity of first filter material in the rod can comprise means for evaluating signals which denote the monitored draw resistance and a motor or other suitable means for varying the speed of advancement of first filter material between the first source and the draping means.

If the apparatus is provided with means for monitoring at least two variable characteristics of the rod (e.g., the density and/or mass and the draw resistance), such apparatus comprises a first monitoring device which generates first signals denoting variations of the one of the at least two variable characteristics and a second monitoring device which generates second signals denoting variations of the other of the at least two variable characteristics. The regulating means is connected to one of the monitoring devices to regulate the rate of delivery of at least one second filter material in dependency upon the variations of first signals as a result of variations of the respective characteristic (e.g., the mass or density of the filter rod), and such apparatus can further comprise means for regulating the rate of advancement of the first filter material to the draping means (and hence the quantity of first filter material in the rod) in response to variations of the second signals (e.g., in response to fluctuations of draw resistance of the filter rod).

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
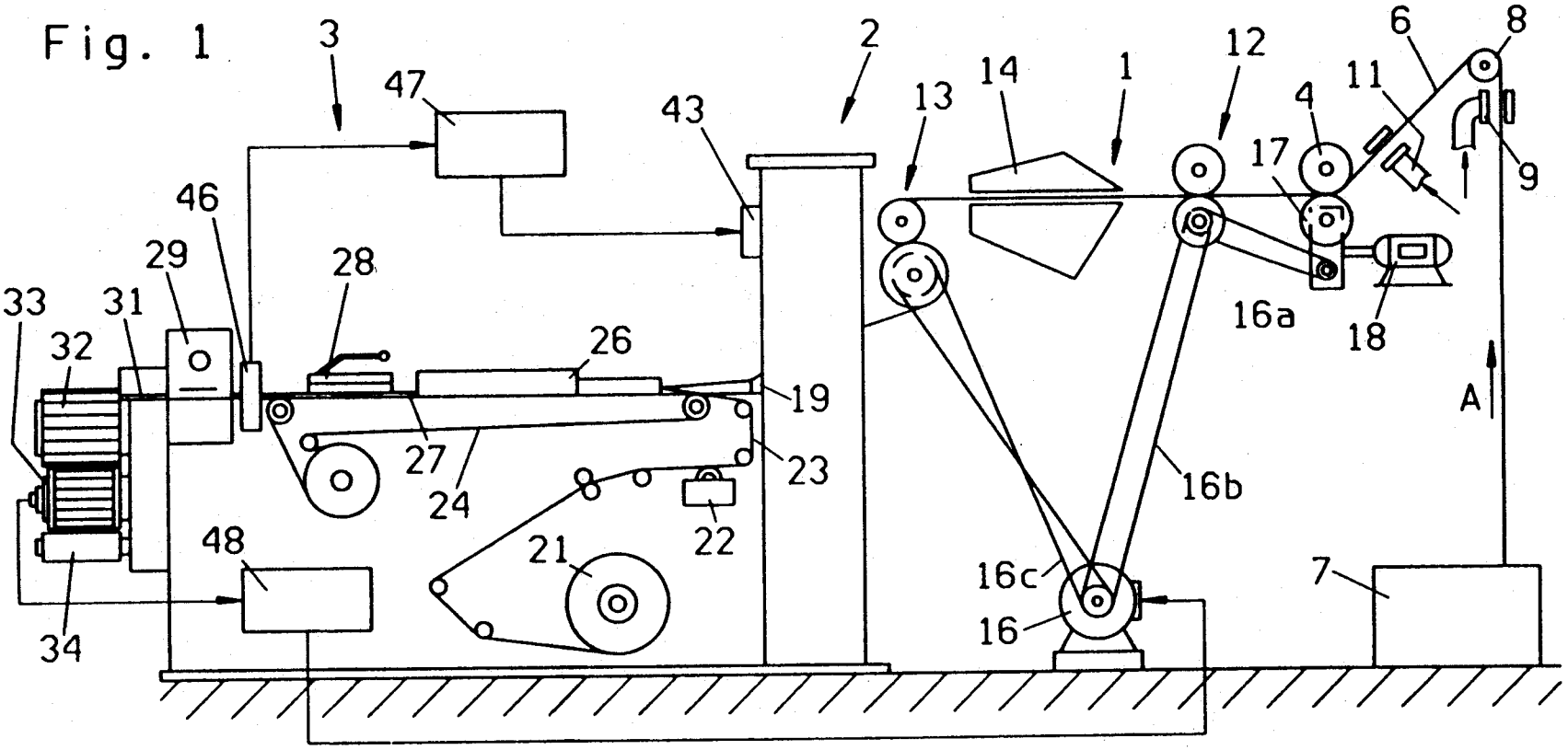
FIG. 1 is a schematic elevational view of a filter rod making apparatus which embodies one form of the present invention and is designed to make a filter rod containing two smoke filtering components.

FIG. 1 shows a filter rod making apparatus which converts a continuous first filter material 6, a comminuted second filter material 37 (FIG. 2) and a continuous web 23 of wrapping material into a continuous filter rod 27 which is thereupon subdivided by a cutoff 29 to yield a file of discrete filter rod sections 31 of unit length or multiple unit length, depending upon the intended use of the filter rod sections For example, the cutoff 29 can subdivide the rod 27 into filter rod sections 31 of double unit length, and such sections can be thereupon admitted into the magazine of a filter tipping machine which combines each filter rod section of double unit length with two plain cigarettes of unit length to form filter cigarettes of double unit length In each such filter cigarette, the filter rod section 31 of unit length is located between the two plain cigarettes of unit length, and the filter cigarettes of double unit length are thereupon severed midway across their filter rod sections to yield pairs of filter cigarettes of unit length. Reference may be had, for example, to commonly owned U.S. Pat. No. 4,776,351 granted Oct. 11, 1988 to Wahle et al. for "Method of and apparatus for applying adhesive to a running web of wrapping material of the tobacco processing industry". The disclosure of this patent, as well as the disclosure of each other U.S. patent mentioned herein, is incorporated by reference.

The apparatus which is shown in FIG. 1 can be said to comprise three main units or groups, namely a treating unit 1 for the first filter material 6, a supplying or feeding unit 2 which delivers metered quantities of second filter material 37 into the elongated path for advancement of the first filter material 6, and a converting unit 3 wherein the filter materials 6, 37 are draped into the web 23 to jointly form the continuous rod 27. The first filter material 6 is an elongated web or tow of acetate fibers or other filamentary filter material which is caused to advance in the direction of arrow A along an elongated path extending from a source 7 of tow to and beyond the converting unit 3. The source 7 can be constituted by a customary bale of highly compacted filamentary material, and the means for advancing the tow 6 along its path from the bale 7 toward and past the supplying unit 2 includes three pairs of driven advancing rolls 4, 12 and 13 and a variable-speed motor 16 which transmits torque to the rolls 4, 12 and 13 through belt or chain transmissions 16*a*, 16*b*, 16*c*, respectively. The speed of the advancing rolls 12 and 13 can be varied by varying the speed of the motor 16, and the speed of the advancing rolls 4 can be varied by varying the speed of the motor 16 and/or by varying the ratio of a gear transmission or another suitable transmission 17 by a servomotor 18 or by hand.

The tow 6 is trained over a pulley 8 which is installed between the bale 7 and the first pair of advancing rolls 4, and such tow is treated (spread out) by two so-called banding devices 9 and 11, one upstream and the other downstream of the pulley 8. Each of these banding devices comprises at least one nozzle with a plurality of air discharging orifices at one side of the path for the tow 6, and a plate opposite the orifices at the other side of the path. The banding devices 9 and 11 loosen the filaments of the tow 6 and permit or cause the tow to form a relatively wide layer of parallel or nearly parallel filaments not later than when successive increments of such filaments reach the nip of the advancing rolls 4. The banding devices 9 and 11 can be of the type disclosed in commonly owned U.S. Pat. No. 4,259,769 granted Apr. 7, 1981 to Greve et al. for "Method and apparatus for banding tows of filamentary material".

As a rule, the filaments of the tow 6 are crimped, at least in the bale 7. Therefore, the apparatus preferably further comprises means for stretching the filaments on their way toward the supplying unit 2. The stretching means includes the advancing rolls 4, 12 and the means 17, 18 for varying the speed of the advancing rolls 4 relative to the speed of the advancing rolls 12. Thus, if the peripheral speed of the advancing rolls 4 is less than the peripheral speed of the advancing rolls 12, the filaments of the tow 6 are stretched between the rolls 4 and 12 to an extent which can be selected by adjusting the ratio of the transmission 17 via servomotor 18.

The stretched tow 6 is thereupon treated between the rolls 12 and 13 during advancement through a device 14 which serves to apply to the at least substantially parallel filaments of the tow a softening or plasticizing agent (such as triacetin) which causes discrete portions of the filaments to adhere to each other upon conversion of the tow into a rod during passage through the converting unit 3. The device 14 can be of the type disclosed in commonly owned U.S. Pat. No. 4,132,189 granted Jan. 2, 1979 to Greve et al. for "Apparatus for applying plasticizer to fibrous filter material in filter rod making machines". The plasticizer is preferably admitted at an accurately controlled rate.

The motor 16 can be replaced by two motors, one for the pairs of advancing rolls 12, 13 and the other for the pair of advancing rolls 14, or by three discrete motors, one for each of the pairs of advancing rolls 4, 12 and 13.

The banded, stretched and plasticizer-carrying tow 6 thereupon advances past the supplying unit 2 where it entrains accurately metered quantities of the second filter material 37 (in a manner to be described in greater detail with reference to FIG. 2), and the filter materials 6, 37 then enter a so-called gathering horn 19 which forms part of the converting unit 3 and serves to condense the filter materials so that such materials together form a rod-like body which is entrained by an endless belt conveyor 24 known as garniture and serving to advance the rod-like body through a draping or wrapping mechanism 26 of the converting unit 3. The belt conveyor 24 further serves to entrain the web 23 of wrapping material (e.g., cigarette paper or imitation cork) so that the web 23 is draped around the rod-like body (containing the filter materials 6, 37 and the applied plasticizer) to form therewith the aforementioned continuous filter rod 27. The web 23 is drawn off a source in the form of a bobbin 21 of convoluted wrapping material, and at least one marginal portion at one side of the running web 23 is coated with a suitable adhesive during advancement along a paster 22. Such adhesive is needed to form a seam between the coated marginal portion and the other marginal portion of the web 23 when the latter is draped over the rod-like body 6+37 during advancement through the wrapping mechanism 26.

The seam between the overlapping marginal portions of the tubular envelope (draped web 23) of the filter rod 27 is thereupon dried by a heated plate-like member 28 (called sealer), and the leader of the rod 27 is repeatedly severed by the cutoff 29 which converts the rod 27 into a file of discrete filter rod sections 31 of unit length or multiple unit length. Successive filter rod sections 31 enter successive axially parallel peripheral flutes of a rotary drum-shaped conveyor 32 which advances the filter rod sections sideways (i.e., at right angles to their respective axes) and deposits the sections into successive axially parallel peripheral flutes of a testing conveyor 33 forming part of means for monitoring the draw resistance of filamentary and other filter materials in the respective sections 31. The thus tested filter rod sections 31 are transferred onto a withdrawing conveyor 34 (e.g., an endless belt or chain conveyor) which transports them to storage or to a further processing station, e.g., into the magazine of a filter tipping machine. If the filter rod sections are delivered to storage (e.g., into a reservoir of the type known as RESY and distributed by the assignee of the present application), they remain in storage at least for a period of time which is needed or desirable to ensure that the plasticizer sets before the sections 31 enter the magazine of a filter tipping machine.

Figure 2:
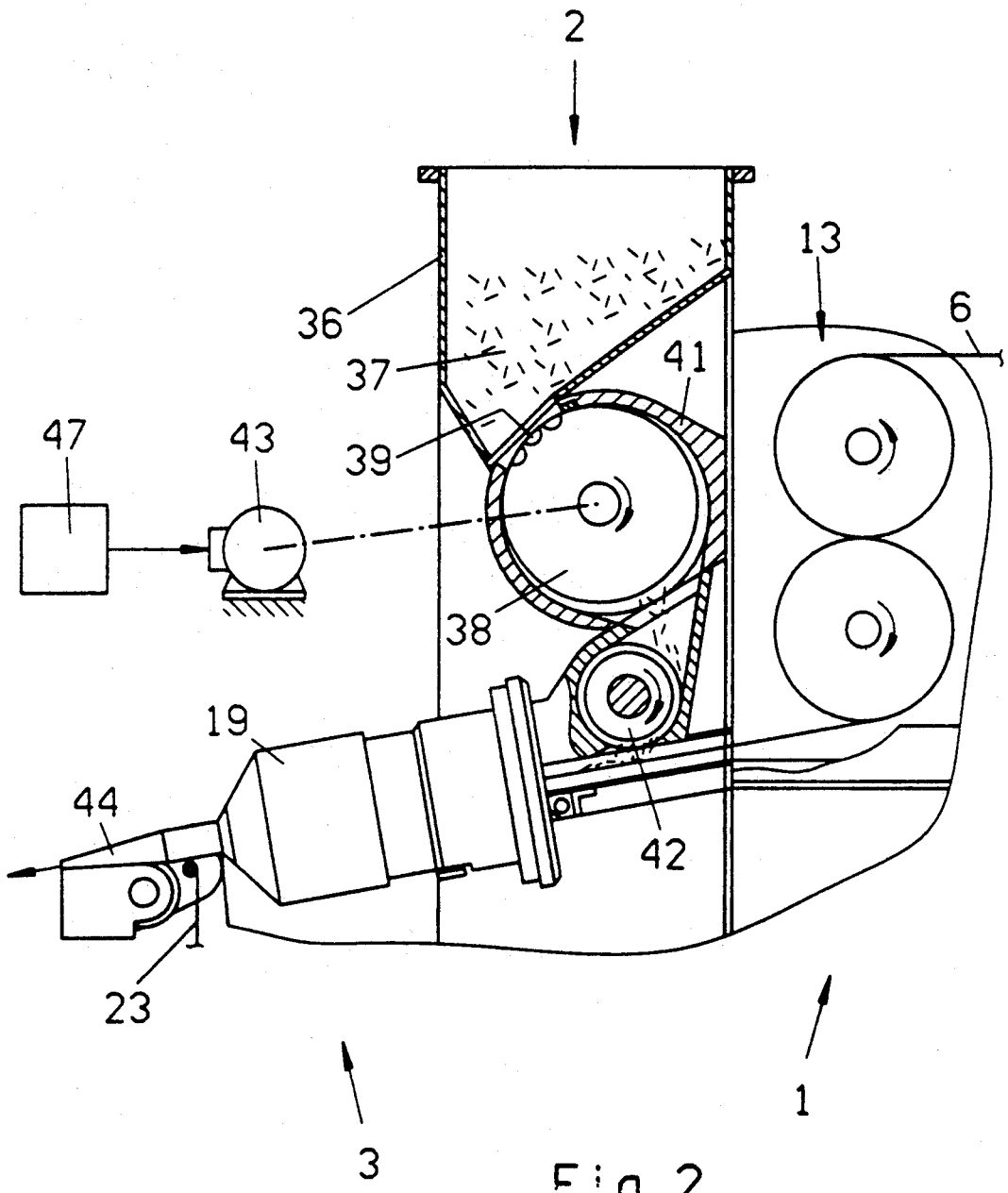
FIG. 2 is an enlarged fragmentary partly elevational and partly vertical sectional view of a detail in the apparatus of FIG. 1, showing the manner of transferring a granular of pulverulent second tobacco smoke filtering component from a source to a running tow of filamentary filter material.

FIG. 2 shows the details of one presently preferred supplying unit 2 which delivers metered quantities of second filter material 37 (preferably activated carbon which is used for the making of charcoal filters) from a source 36 (e.g., a magazine) into a first portion of the elongated path for the tow 6. The supplying unit 2 is preferably adjacent or closely adjacent the advancing rolls 13 so that it delivers metered quantities of filter material 37 onto successive increments of the spread out and stretched portion of the advancing tow 6.

The outlet at the lower end of the magazine 36 is adjacent the path of an annulus of pockets 39 in the periphery of a rotary withdrawing roller or drum 38 which is driven by a variable-speed motor 43 to rotate in a clockwise direction and to transport batches (metered quantities) of pulverulent or granular filter material 37 along the inner side of a housing or shroud 41 and into the range of a rotary applicator 42 (e.g., a cylindrical brush whose bristles propel the particles of filter material 37 against the adjacent side of the layer of filamentary filter material forming the tow 6 immediately downstream of the advancing rolls 13 and upstream of the gathering horn 19 of the converting unit 3. The applicator 42 can be driven in synchronism with the advancing rolls 13, e.g., by receiving torque directly from the motor 16 or from the rolls 12 or 13 This applicator constitutes an optional part of the improved apparatus, i.e., it can be dispensed with if the roller or drum 38 (or an equivalent of this roller or drum) can deliver the filter material 37 directly to the adjacent (first) portion of the path for the tow 6 with a required degree of uniformity.

The gathering horn 19 of the converting unit 3 comprises a finger-like member 44 which assists in condensing the filter materials 6, 37 into a rod-like body which is ready to enter the wrapping mechanism 26 and to be draped into the web 23 to form therewith the aforementioned continuous filter rod 27

In accordance with a feature of the invention, the apparatus further comprises means 46 for monitoring a selected characteristic (such as the mass or density) of successive increments of the rod 27 and for generating signals which are processed and thereupon used to regulate the speed of the motor 43, i.e., the rate of delivery of second filter material 37 to the tow 6. The means for evaluating and processing signals from the monitoring means 46 comprises a suitable control circuit 47 whose output is connected with the controls for the motor 43 The circuit 47 and the motor 43 can be said to constitute a means for regulating the quantity of second filter material 37 which is being admitted into the path of advancement of the tow 6 toward the wrapping mechanism 26 of the converting unit 3 The wrapping mechanism 26 is located in a second portion, the cutoff 29 is located in a third portion, and the testing drum 33 is located in a fourth portion of the elongated path for the tow 6.

Monitoring devices which can ascertain the density or mass of a continuous flow of fibrous material (such as a tow of filter material for tobacco smoke or a stream of comminuted tobacco particles) are disclosed, for example, in commonly owned U.S. Pat. Nos. 4,865,054 (granted Sep. 12, 1989 to Lorenzen et al for "Method of and apparatus for making and processing streams of fibrous material of the tobacco processing industry"), 4,878,506 (granted Nov. 7, 1989 to Pinck et al. for "Method of and apparatus for treating accumulations of fibers of tobacco or other smokable material"), 4,889,139 (granted Dec. 26, 1989 to Heitmann for "Method of and machine for making a rod-like filler of fibrous material"), 4,926,886 (granted May 22, 1990 to Lorenzen et al. for "Method of and apparatus for making a trimmed steam of tobacco fibers or the like") and 4,941,482 (granted Jul. 17, 1990 to Heitmann et al. for "Apparatus for measuring the density of a tobacco stream").

The testing drum 33 can form part of draw resistance measuring means of the type described, for example, in published German patent application No. 22 59 715 or in commonly owned U.S. Pat. No. 4,223,551 granted Sep. 23, 1980 to Greve et al. for "Apparatus for ascertaining the resistance of cigarettes or the like to axial flow of gases therethrough" Signals which are generated by the monitoring means including the testing drum 33 are transmitted to an evaluating circuit 48 which, in turn, transmits processed signals to the controls for the variable-speed motor 16 to cooperate with this motor in varying the speed of advancement of the tow 6 toward the wrapping mechanism 26 as a function of variations of draw resistance of filter materials in successively tested filter rod sections 31, i.e., as a function of draw resistance of filter materials in the rod 27.

Figure 1A:
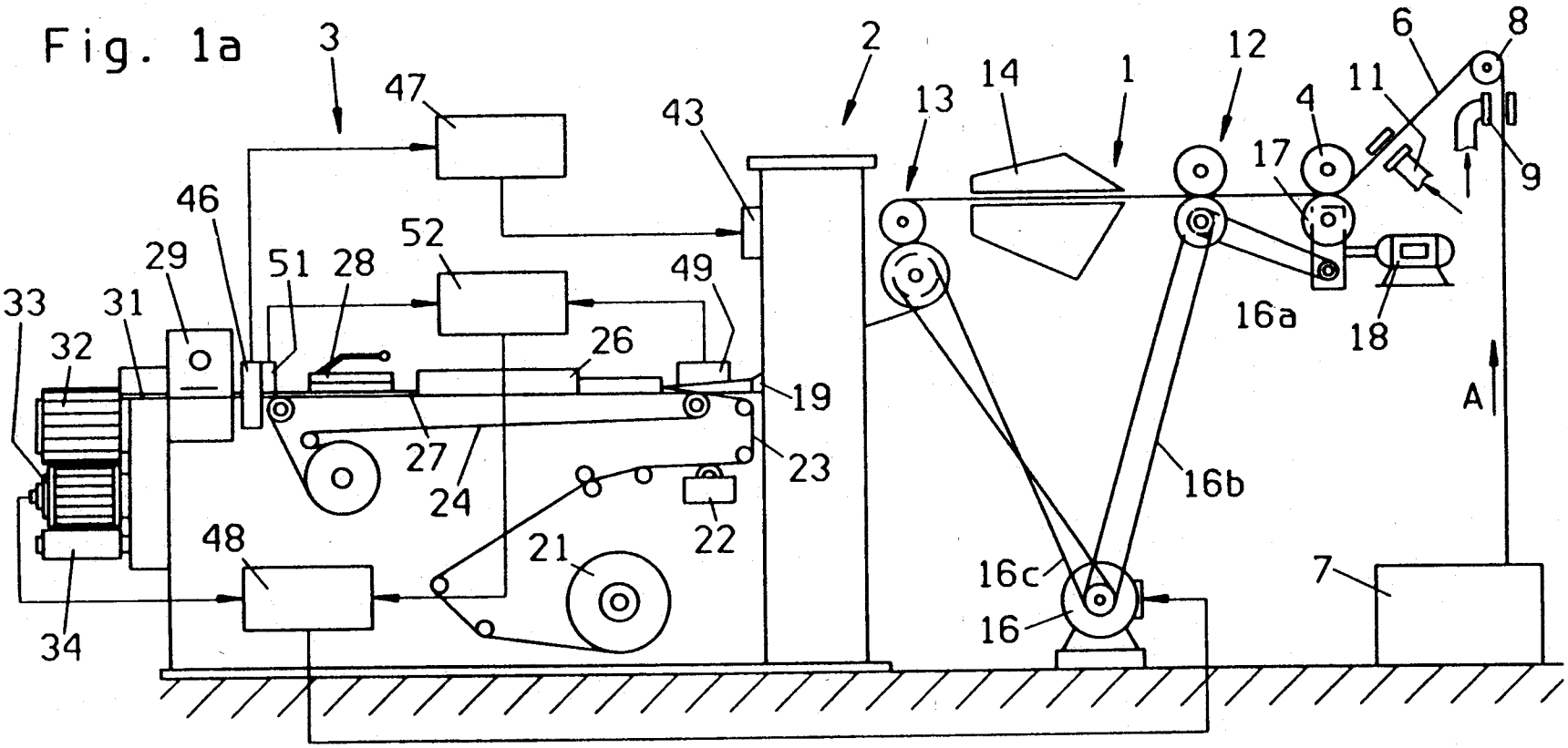
FIG. 1*a* is a similar schematic elevational view of a modified filter rod making apparatus.

The testing drum 33 can be omitted (or it can merely perform the function of transferring successive filter rod sections 31 from the conveyor 32 onto the conveyor 34) if the means for monitoring the draw resistance of the rod 27 is installed ahead of the cutoff 29, i.e., before the rod 27 is subdivided into discrete filter rod sections 31. Such monitoring means is shown in FIG. 1*a*, as at 49, and is adjacent the aforementioned finger-like member 44 at the gathering horn 19 of the converting unit 3. Monitoring means for ascertaining the draw resistance of fibrous filter material (with or without other filter material or materials) is disclosed, for example, in U.S. Defensive Publication No. T 941 011 to which reference may be had, if necessary. As a rule, the measurements which are carried out by the monitoring means 49 can or should be modified or corrected because this monitoring means is located upstream of the wrapping mechanism 26 wherein the draw resistance of filter materials of the rod 27 is likely or bound to undergo additional changes. The wrapping mechanism 26 changes the diameter of filter materials (6+37) prior to or during wrapping into the web 23 of wrapping material, and this will entail certain changes of draw resistance of filter materials of the rod 27 and filter rod sections 31. The means for generating signals which are used to correct the signals from the monitoring means 49 includes a diameter measuring unit 51 which is installed downstream of the wrapping mechanism 26 but upstream of the cutoff 29 (e.g., adjacent the monitoring means 46) and transmits correction signals to an evaluating and processing circuit 52 which also receives signals from the monitoring means 49. The circuit 52 transmits corrected signals to the evaluating circuit 48 which controls the speed of the motor 16 and hence the rate of advancement of the tow 6 toward the converting unit 3.

As shown in FIG. 1*a*, the parts 49, 51 and 52 can be utilized in lieu of the monitoring means including the testing drum 33 of FIG. 1. As already stated hereinbefore, the drum 33 of FIG. 1*a* merely performs the function of transferring successive filter rod sections from the conveyor 32 onto the conveyor 34.

The monitoring means 46 can operate with a source of radiation (e.g., beta rays or other penetrative radiation) or any other suitable radiation (e.g., infrared light) and with means for ascertaining the intensity of radiation which has penetrated through or has been reflected by the filter materials and is indicative of the mass or density of such materials. Monitoring means which utilize sources of beta radiation are used in many machines for the processing of fibrous material of the tobacco processing industry. Reference may be had, for example, to the aforementioned U.S. Pat. No. 4,889,139 to Heitmann.

The operation is as follows:

The motor 16 is on to drive the rolls 4, 12 and 13 which draw the tow 6 from the bale 7 past the banding devices 9, 11, through the stretching zone between the pairs of advancing rolls 4 and 12, and thereupon through the device 14 which applies metered quantities of a plasticizer between the pairs of advancing rolls 12 and 13. The supplying unit 2 delivers metered quantities of second filter component 37 to successive increments of the tow 6 between the pair of advancing rolls 13 and the gathering horn 19 of the converting unit 3. Thus, the roller or drum 38 is driven by the motor 43 so that it draws batches of activated carbon granulae or powder from the magazine 36 and to deliver such batches to the applicator 42 whose bristles propel the pulverulent or granular filter material against the adjacent filaments of the advancing tow 6. The thus formed composite filter material enters the gathering horn 19 to advance past the finger-like member 44 and to be thus condensed before entering the wrapping mechanism 26 which confines it in the web 23 of cigarette paper or the like. The cutoff 29 severs the leader of the advancing filter rod 27 to form a file or series of discrete filter rod sections 31 which are delivered into the flutes of the drum 32 on their way into the flutes of the testing drum 33 and thence onto the upper reach of the conveyor 34.

The monitoring means including the testing drum 33 ascertains the draw resistance of the filter rod sections 31 (i.e., the draw resistance of the rod 27) and transmits appropriate signals to the evaluating circuit 48 which cooperates with the variable-speed motor 16 to vary the speed of advancement of the tow 6 when the monitored draw resistance departs from an optimal draw resistance. A signal denoting the optimal draw resistance can be supplied by a suitable source of reference signals (e.g., a potentiometer) which is connected with or is incorporated into the evaluating circuit 48. The adjustment of the speed of the motor 16 is preferably such that the draw resistance of the rod 27 remains at least substantially constant.

At the same time, the monitoring means 46 ascertains the density or mass of successive increments of the rod 27 ahead of the cutoff 29 and transmits appropriate signals to the evaluating circuit 47. The latter cooperates with the variable-speed motor 43 to regulate the quantity of filter material 37 which is being supplied into the path of advancement of the tow 6. The adjustment is preferably such that the characteristic (such as density or mass) which is monitored by the monitoring means 46 remains at least substantially constant. The filter material 37 exerts minimal influence or no influence at all upon the draw resistance of the filter rod 27 and its sections 31. Therefore, variations of the rate of admission of filter material 37 to the advancing tow 6 at the station for the applicator 42 do not appreciably influence the draw resistance of the filter rod sections 31, i.e., such draw resistance can be regulated by the monitoring means including the testing drum 33 (in conjunction with the evaluating circuit 48 and motor 16) irrespective of variations of the speed of the motor 43, i.e., regardless of variations of the rate of admission of filter material 37 for the purpose of maintaining the density or mass of the rod 27 and its sections 31 at a constant value Thus, the improved method and apparatus render it possible to simultaneously regulate the density or mass as well as the draw resistance of the filter rod 27 and its sections 31.

An important advantage of the improved method and apparatus is that the mass or density of the filter rod 27 remains constant or departs from an optimum value only for extremely short intervals of time. This is due to the provision of monitoring means 46, evaluating circuit 47 and motor 43, i.e., due to the provision of means for regulating the quantity of supplied filter material 37 for the purpose of maintaining the density or mass of the rod 27 at a constant value. Moreover, the regulating means 43, 46, 47 renders it possible to achieve substantial savings in filter material 37 because this filter material is merely supplied in quantities which are needed to ensure that the mass or density of the filter rod 27 will match or at least closely approximate an optimal value for use in connection with particular types of plain cigarettes or other tobacco-containing rod-shaped articles of the tobacco processing industry. Savings in filter material which is added to the tow 6 are particularly desirable and important if the second or additional filter material or materials are more expensive than the other material or materials (such as the tow 6) within the tubular envelope which is formed by the draped web 23 of cigarette paper or the like.

Another important advantage of the improved method and apparatus is that the mass or density of the filter rod 27 can be maintained at a constant value (by regulating the rate of admission of filter material 37) without influencing the draw resistance of the filter rod. The draw resistance is regulated by varying the rate of advancement of the tow 6 from the bale 7 to the converting unit 3. The reason that the draw resistance can be regulated independently of the mass or density and vice versa is that the filter material 37 influences the mass or density of the filter rod 27 very little or not at all. This, in turn, renders it possible to turn out filter rod sections 31 of superior quality, i.e., filter rod sections whose mass or density as well as draw resistance match or very closely approximate optimal values.

A further important advantage of the improved method and apparatus is that the selected mass or density or the selected draw resistance of the filter rod 27 can be maintained at a constant value as long as desired as well as that the selected optimal density or mass or the selected optimal draw resistance can be altered in a simple and time-saving manner, namely by appropriate adjustments of the control circuit 47 or 48.

The improved apparatus can be modified in a number of ways without departing from the spirit of the invention. For example, the apparatus can employ other types of suitable mass, density and draw resistance monitoring means. Furthermore, though it is preferred to resort to in-line monitoring of one or more important characteristics of the rod 27 and/or of its sections 31, it is equally within the purview of the invention to monitor at least one characteristic upon removal of a certain number of filter rod sections 31 from the improved apparatus. For example, the draw resistance of selected numbers of filter rod sections 31 can be monitored in a laboratory, and the results of such measurements can be utilized to manually or otherwise adjust the controls for the motor 16 in order to alter the draw resistance by altering the rate of advancement of the tow 6 from the bale 7 toward the wrapping mechanism 26.

Furthermore, activated carbon (charcoal) is but one of filter materials which can be added to the tow 6 in order to beneficially influence the smoke filtering characteristics of the filter rod sections. It is equally possible to provide one or more additional supplying devices (analogous to the device 2) for delivery of one or more additional filter materials to the tow 6 upstream or downstream of the applicator 42.

It is also possible to regulate only the delivery of filter material 37 in dependency on the mass or density of the filter rod 27 or to regulate only the rate of advancement of the tow 6 in dependency on variations of the draw resistance of successively monitored filter rod sections 31 or in dependency on variations of draw resistance of successive increments of the rod 27.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

I claim:

1. Method of producing filter rod sections for the making of filter cigarettes and analogous smokable rod-shaped articles, comprising the steps of advancing a continuous first filter material in a predetermined direction along an elongated path; delivering into a first portion of said path at least one second filter material which contains activated carbon and jointly advancing said filter materials beyond said first portion; draping the filter materials into a wrapping material in a second portion of said path to form a continuous rod having a variable mass and a variable draw resistance; subdividing the rod into a series of filter rod sections in a third portion of said path downstream of said second portion; monitoring the mass and the draw resistance of the rod and generating first and second signals respectively denoting the monitored mass and draw resistance; regulating the rate of delivery of said at least one second filter material as a function of variations of said first signals in response to variations of the monitored mass; and regulating the quantity of first filter material in the rod as a function of variations of said second signals in response to variations of draw resistance so as to maintain the draw resistance at or close to a predetermined value.

2. The method of claim 1, further comprising the step of monitoring the density of the rod.

3. The method of claim 1, wherein said monitoring step includes monitoring the mass and draw resistance in said path.

4. The method of claim 1, wherein said monitoring step includes monitoring the the mass and draw resistance of filter rod sections.

5. The method of claim 4, wherein said monitoring step is carried out outside of said path.

6. Apparatus for producing filter rod sections for the making of filter cigarettes and analogous smokable rod-shaped articles from an elongated first filter material and at least one second filter material containing granulae of activated carbon, comprising means for advancing the first filter material from a first source in a predetermined direction along an elongated path; means for delivering said at least one second filter material from a second source into a first portion of said path so that the thus supplied at least one second filter material advances with the first filter material; means for draping said filter materials into a wrapping material in a second portion of said path downstream of said first portion to form a continuous filter rod having a variable mass and a variable draw resistance; means for subdividing the rod into a series of discrete filter rod sections in a third portion of said path downstream of said second portion; means for monitoring the mass and the draw resistance of the filter rod and for generating first and second signals respectively denoting the monitored mass and draw resistance; means for regulating the rate of delivery of said at least one second filter material into the first portion of said path as a function of variations of said first signals in response to variations of the mass of the filter rod; and means for regulating the quantity of first filter material as a function of said second signals denoting monitored variations of draw resistance of the rod.

7. The apparatus of claim 6, wherein said second source is adjacent said first portion of said path.

8. The apparatus of claim 6, wherein said monitoring means includes a source of penetrative radiation and means for directing radiation from the respective source against the rod.

9. The apparatus of claim 6, wherein said monitoring means comprises means for monitoring the draw resistance of said filter rod sections.

10. The apparatus of claim 9, wherein said monitoring means is adjacent a fourth portion of said path downstream of said third portion.

11. The apparatus of claim 6, wherein said means for regulating the delivery of said at least one second filter material includes means for evaluating said second signals and means for varying the speed of advancement of first filter material between said first source and said draping means.

* * * * *